United States Patent [19]

Talmor

[11] Patent Number: 4,680,535

[45] Date of Patent: Jul. 14, 1987

[54] STABLE CURRENT SOURCE

[75] Inventor: Shlomo S. Talmor, Syosset, N.Y.

[73] Assignee: Harris Corporation, Melbourne, Fla.

[21] Appl. No.: 823,672

[22] Filed: Jan. 29, 1986

Related U.S. Application Data

[63] Continuation-in-part of Ser. No. 788,236, Oct. 17, 1985.

[51] Int. Cl.[4] ..... G05F 3/04

[52] U.S. Cl. ..... 323/312; 323/907

[58] Field of Search ..... 323/312, 315, 316, 907; 307/296 R, 297

[56] References Cited

U.S. PATENT DOCUMENTS

| | | | |
|---|---|---|---|
| Re. 29,619 | 4/1978 | Pastoriza | 340/347 DA |
| 2,716,729 | 8/1955 | Shockley | 323/312 |
| 3,536,986 | 10/1970 | Perlman | 323/312 |
| 3,573,595 | 4/1971 | Galluppi | 323/312 X |
| 3,675,122 | 7/1972 | Rose | 324/62 |
| 3,784,844 | 1/1974 | McGrogan, Jr. | 307/270 |
| 3,787,734 | 1/1974 | Dorler et al. | 307/203 |
| 3,899,692 | 8/1975 | Caswell | 307/228 |
| 3,979,663 | 9/1976 | Herchner | 323/312 |
| 4,104,575 | 8/1978 | Bauer | 307/297 X |
| 4,112,346 | 9/1978 | Tokunaga et al. | 307/297 X |
| 4,150,309 | 4/1979 | Tokunda | 307/310 |
| 4,240,024 | 12/1980 | Blackburn | 323/312 |
| 4,251,743 | 2/1981 | Hareyama | 323/316 X |
| 4,504,882 | 3/1985 | Breton | 361/93 |
| 4,570,115 | 2/1986 | Misawa et al. | 323/907 X |

*Primary Examiner*—Peter S. Wong

*Attorney, Agent, or Firm*—Scully, Scott, Murphy & Presser

[57] ABSTRACT

A highly stable current source which is protected against high voltage overloads, comprising a loop circuit in which the current of known magnitude Iref passes through a scaler resistor to develop a voltage drop thereacross, which is connected with a floating potential in a loop circuit. A differential amplifier is coupled to differentially measure the voltages across the scaler resistor and the floating potential, and provides an output indicative thereof, which determines Iref. In this arrangement, the voltage drop across the scaler resistor equals the voltage drop across the floating potential, and the current Iref through the scaler resistor remains constant at a known magnitude. Embodiments of both positive and negative current generating circuits are disclosed.

15 Claims, 6 Drawing Figures

STABLE CURRENT SOURCE

This is a continuation-in-part application of patent application Ser. No. 788,236, filed Oct. 17, 1985.

BACKGROUND OF THE INVENTION

1. Field of the Invention

The present invention relates generally to a highly stable current source, which may be utilized in any suitable application requiring a stable current source, such as, for example, in an ohms converter circuit for measuring the resistance of an unknown resistor. More particularly, the subject invention pertains to a highly stable current source in which the actual output current of the current source is monitored to ensure its accuracy. The circuit of the present invention is not temperature dependent, and is protected against the accidental application thereto of high voltages.

2. Discussion of the Prior Art

In a number of electrical control and supply circuits and systems in the prior art, it is highly desirable, or even necessary for satisfactory performance, that the current supplied to an operating element or load be substantially constant, unaffected by temperature changes or by voltage or current variations in the circuit or system, and essentially independent of the impedance of the element or load. One such prior art circuit concerns an ohm's converter circuit for measuring the resistance value of an unknown resistor.

In a digital multimeter, an ohms measurement is commonly performed by measuring the voltage drop produced across an unknown resistor with the application thereto of a known current flow. In order to get an accurate reading, two measurements must be performed simultaneously, namely the voltage drop across and the current flow through the unknown resistor. This measurement technique generally utilizes either a sample and hold circuit or two A/D converters. However, both approaches are generally unacceptable because mismatches and drift create errors in the measurements.

In lieu of performing simultaneous measurements, the approach of an ohms converter circuit can be employed, which utilizes a highly stable current source such as that provided by the present invention. Most ohms converter circuits regulate the voltage drop across the emitter resistor of a transistor, the collector of which is the output. With this approach, the beta of the output transistor changes with temperature and with changes of $V_{CE}$, which causes $I_C$ to change, thereby creating an inherent error. The stable current source of the present invention eliminates this basic design flaw by monitoring the actual output current of the current source.

Although the highly stable current source of the subject invention is specifically disclosed in the context of an ohms converter circuit, the present invention is useful in providing a stable current source useful in any general application requiring a highly stable current source.

SUMMARY OF THE INVENTION

Accordingly, it is a primary object of the present invention to provide a highly stable current source circuit in which the actual output current of the current source is monitored to ensure its accuracy.

A further object of the subject invention is the provision of a highly stable current source which is relatively unaffected by changes in temperature and which is protected against the accidental application thereto of high voltage overloads. A practical requirement of a stable current source circuit is that the circuitry should not be damaged by the accidental application to its input of a high voltage overload. In the present invention, reverse or negative voltage overload protection for the circuit is provided by a blocking diode which blocks an accidental application of a negative voltage across the input terminals from being applied to the circuit. Additionally, positive voltage overload protection is provided by two clamping diodes, coupled between the circuit and ground, which provide high voltage overload for the circuit by clamping the anodes thereof to a given positive voltage.

In accordance with the teachings herein, a current of known magnitude Iref is delivered by a highly stable current source, which avoids a prior art problem with the $V_{CE}$ and temperature dependence of an output transistor. The ohms converter of the present invention eliminates this basic design problem by monitoring the actual output current of the current source. The current of known magnitude Iref is passed through a scaler resistor to develop a voltage drop thereacross, which is connected with a floating potential in a loop circuit. A differential amplifier is coupled to differentially measure the voltages across the scaler resistor and the floating potential, and provides an output indicative thereof, which controls the generation of Iref. In this arrangement, the voltage drop across the scaler resistor equals the voltage drop across the floating potential, and the current Iref through the scaler resistor remains constant at a known magnitude.

In greater detail, in one disclosed embodiment the floating potential preferably comprises a steady current source and a floating potential resistor Rfp. An inverting amplifier is coupled to the output of the differential amplifier for providing enhanced voltage compliance and for isolation in the event of the accidental application of a high voltage to the circuit. The inverting amplifier is a transistor amplifier, and a voltage follower circuit is coupled to the floating potential resistor Rfp to prevent the current therethrough from flowing to the collector of the transistor inverting amplifier. Preferably, the stable current source includes an MOS amplifier, and the differential and inverting amplifiers and the voltage follower circuit also comprise MOS circuits.

BRIEF DESCRIPTION OF THE DRAWINGS

The foregoing objects and advantages of the present invention for a stable current source circuit may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
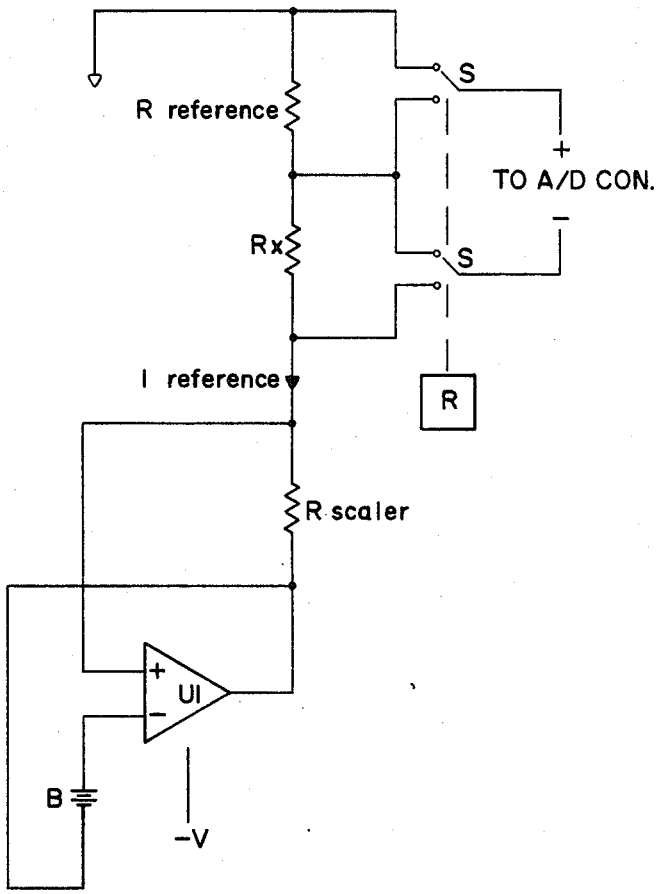
FIG. 1 is a schematic illustration of a simplified conceptual embodiment of an ohms converter circuit employing a simplified version of a stable current source constructed pursuant to the teachings of the present invention.

Referring to the drawings in detail, FIG. 1 is a schematic illustration of a simplified conceptual embodiment of an ohms converter circuit in which an unknown resistance Rx is measured by passing a current of a known magnitude Iref therethrough. The voltage drop across Rx is then measured, thereby allowing the resistance Rx to be determined by Ohm's law R=V/I. In the circuit of FIG. 1, a voltage across a scaler resistor Rscaler is established by passing a current of known magnitude Iref therethrough. The voltage across the scaler resistor Rscaler is compared with a voltage supplied by a floating potential, generated in this embodiment by a battery B. A differential amplifier U1 compares the two voltages as inputs thereto, and controls the generation of the current of known magnitude Iref in accordance with the differential measurement of the voltages. In explanation of the operation of this circuit, any increase in the voltage drop across the scaler resistor Rscaler forces the noninverting input of Ul to become more positive than the inverting input thereof, causing the output of U1 to become more positive, such that the voltage drop across the scaler resistor is less and equals the voltage drop supplied by the floating potential, such that Iref=B/Rscaler.

The current of known magnitude Iref passes from Rscaler without branching through a series connection of Rx and a reference resistor Rref. Relays R are utilized to switch between measurements of the voltage across Rx and the voltage across Rref. The voltage across Rref is checked periodically to update the precise magnitude of Iref. The exact value of Iref is not important, but must be known and is determined by this measurement. Since the current supply provided by the present invention is very stable, the voltage across Rref has to be checked less frequently to verify Iref, and therefore the relays R have to be switched less frequently, resulting in longer lives therefor.

Figure 2:
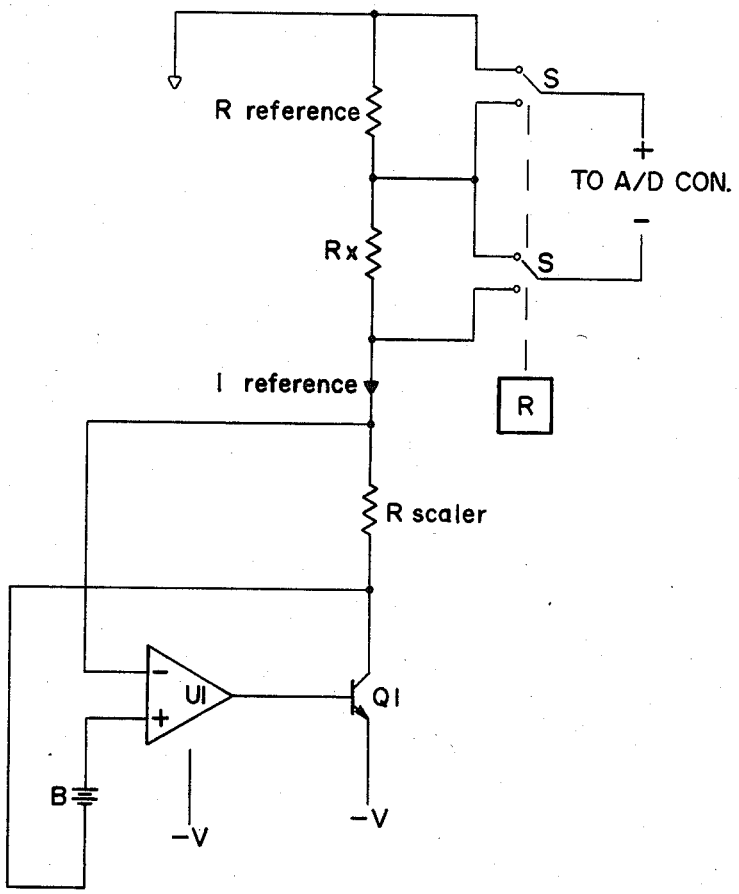
FIG. 2 illustrates a conceptual embodiment of an ohms converter circuit similar to that of FIG. 1, wherein an inverting amplifier has been added to the output of the differential amplifier in the stable current source.

FIG. 2 illustrates a conceptual embodiment of a circuit similar to that of FIG. 1, wherein an inverting amplifier has been added to the output of the differential amplifier therein. In this circuit, the inputs to the differential amplifier U1 are reversed because of the introduction of an inverting amplifier Q1 within the circuit loop. In some circuits, an inverting amplifier transistor Q1 is essential to provide enhanced voltage compliance and the capability of withstanding the accidental application of high voltages thereto.

Figure 3:
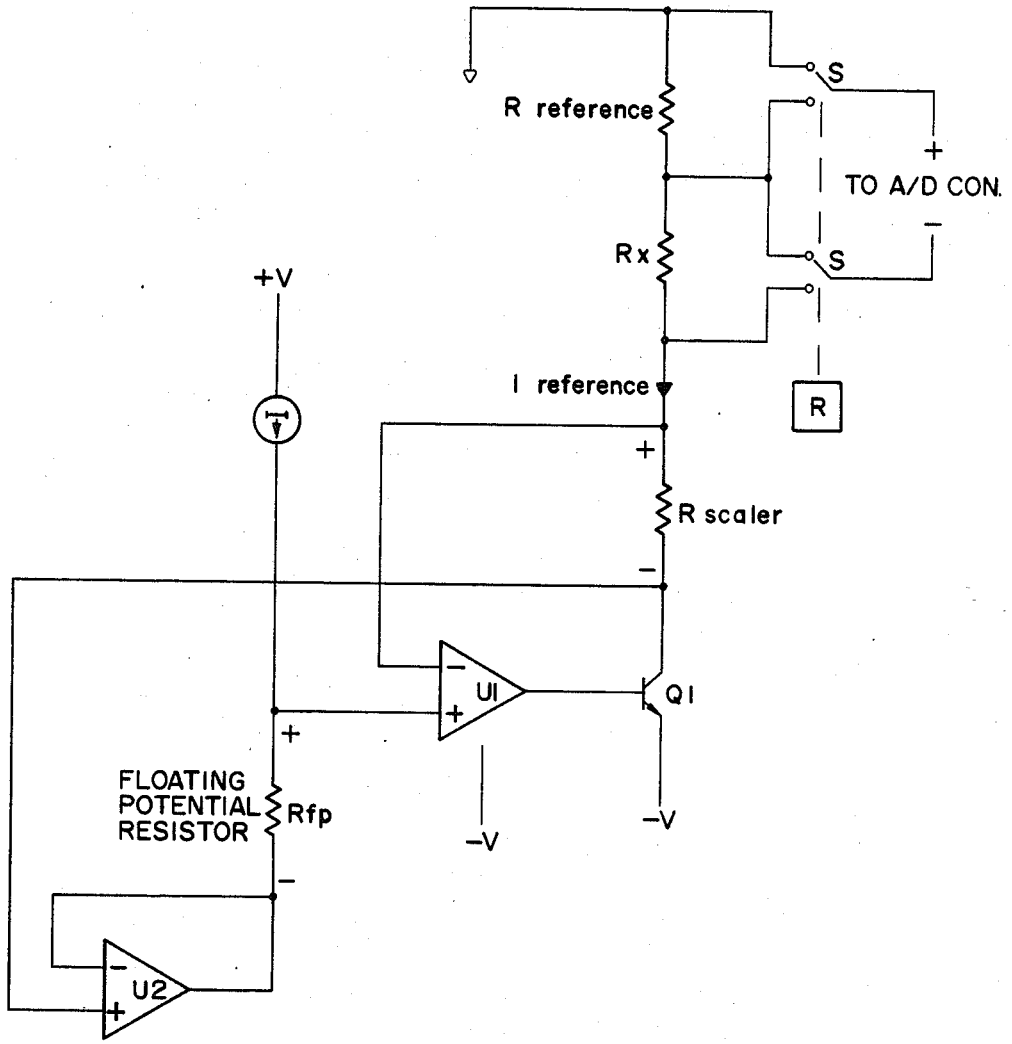
FIG. 3 illustrates a conceptual embodiment of an ohms converter circuit similar to that of FIG. 2, wherein a stable current source and floating potential resistor have replaced the floating potential battery.

FIG. 3 is a slightly more complex circuit than FIG. 2 in which the battery B is replaced by a steady current source I supplying a steady current to a floating potential resistor Rfp to provide a stable floating potential thereacross. In this circuit, U2 is a voltage follower which prevents the current from I from flowing to the collector of Q1, thereby providing a buffering or isolation function in the circuit.

Figure 4:
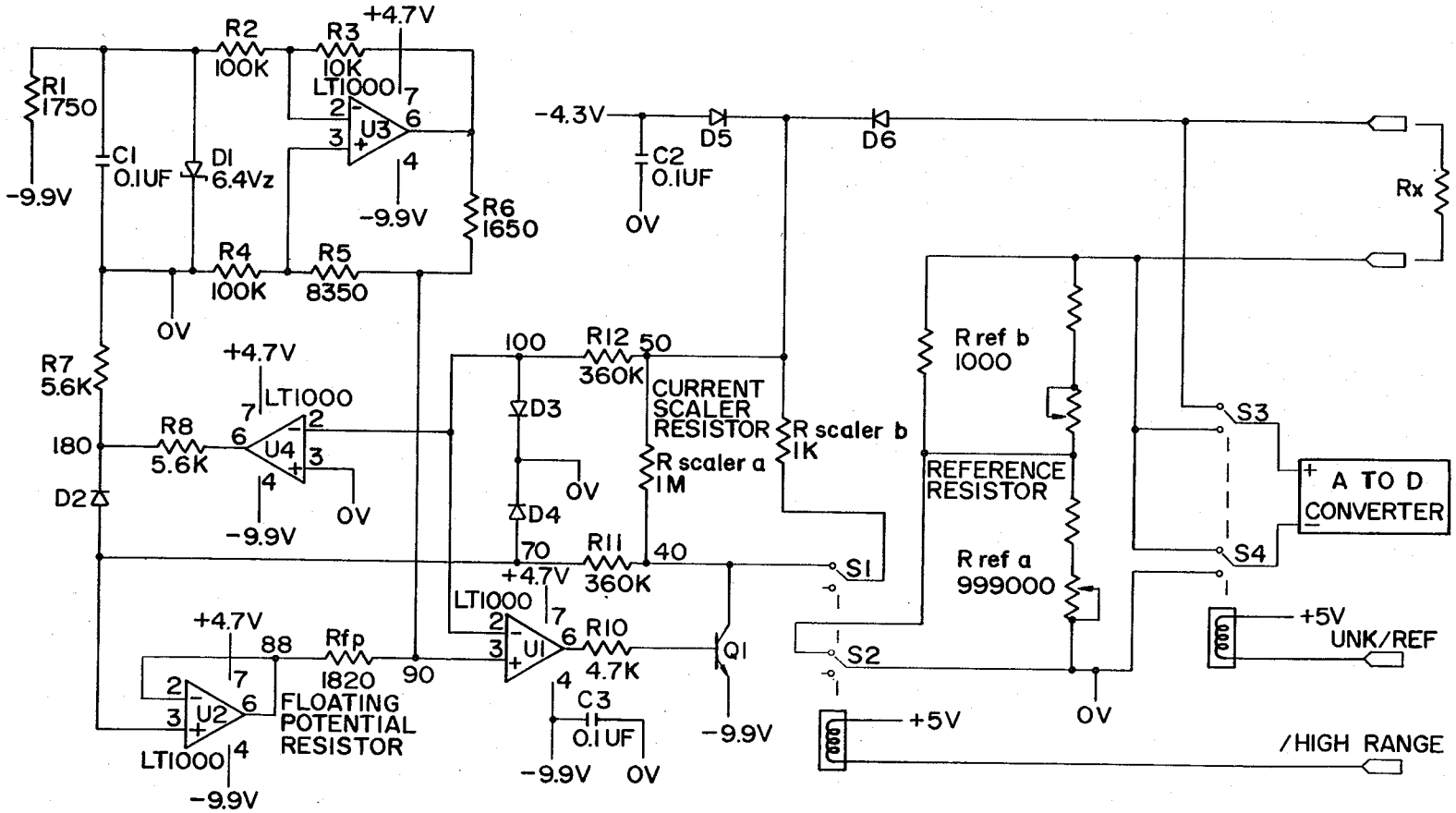
FIG. 4 is a schematic drawing of an ohms converter circuit, similar in concept to FIG. 3, and illustrating fully the complete details of the circuit.

FIG. 4 is a schematic drawing of a preferred embodiment of a stable current source circuit in an ohms converter circuit, similar in concept to FIG. 3, and illustrating fully the complete details of the circuit. In this embodiment, a steady current I is provided by U3, which is an MOS amplifier, and a temperature compensated Zener diode D1. The current source I provides a steady current through the floating potential resistor Rfp to establish a stable bias voltage drop thereacross. U3 produces a constant current=(R3·Vz)/(R2·R6). The use of a temperature compensated Zener reference diode D1 reduces the temperature coefficient of this current source to just a few parts per million.

In this circuit, Iref is determined primarily by the floating potential and the magnitude of the current scaler resistor Rscaler, which is composed of Rscaler a and Rscaler b, and can be selectively changed by relay switch S1. When relay switch S1 is open, Rscaler consists of only Rscaler a which is 1 Mohms. When relay switch S1 is closed, Rscaler comprises both Rscaler a and Rscaler.b in parallel, which is approximately equal to Rscaler b or 1 Kohms because of the much greater value of Rscaler a. In this embodiment, Iref can be selected between approximately 0.7 mAmps and 0.7 uAmps under control of relay R1.

In the embodiment of FIG. 4, Rref is actually formed by five interconnected resistors as shown for ease of construction, precision and switching, but could be just one resistor. In the designed embodiment Rref is either 1 Kohms or 1 Mohms, depending upon the desired value of Iref, which depends upon the anticipated value of Rx and the range of the voltmeter reading the voltage across either Rref or Rx. In this circuit, Rref consists of Rref a, which is 999 Kohms, and Rref b, which is 1 Kohms. When relay S2 is open, Rref is Rref a and Rref b, and when relay S2 is closed, Rref=Rref b only, such that Rref is precisely 1 Kohms or 1 Mohms. Switching by relay S2 is provided in order to maintain a low voltage drop over Rref. If, for instance, Rref=1 Mohms, and Iref=0.7 uAmps, then the voltage drop across Rref=0.7 volts, and when Iref is switched to 0.7 mAmps, the voltage over Rref will equal 700 volts. Therefore, it is desirable to scale Rref when Iref is scaled, such that relays S1 and S2 are switched simultaneously, as indicated by the dashed connection, with both being on or both being off.

Relays S3 and S4 are utilized to switch between measurements of the voltage across Rx and the voltage across Rref. The voltage across Rref is checked periodically to verify the precise magnitude of the current of predetermined value Iref. Since the current supply provided by the present invention is very stable, the voltage across Rref has to be checked less frequently to verify Iref, and therefor the relays S3 and S4 have to be switched less frequently, resulting in longer lives therefor. As illustrated, the voltmeter preferably includes an A to D converter for providing a digital output reading.

An inverting amplifier Q1 is connected in the loop circuit for providing the current of known magnitude Iref through the scaler resistor Rscaler, and establishes a voltage drop IrefRscaler thereacross equal to the voltage drop across Rfp. The inverting amplifier Q1 is coupled to the output of the differential amplifier U1 for providing enhanced voltage compliance and for isolation in the event of the accidental application of a high voltage to the circuit. The inverting amplifier is a transistor amplifier, and a voltage follower circuit U2 is coupled to the floating potential resistor Rfp to prevent the current therethrough from flowing to the collector of the transistor inverting amplifier Q1.

The ohms converter circuit detects the application of a voltage overload, and in response thereto shuts off Q1. This also prevents the reference resistor Rref from dissipating unnecessary power, thereby prolonging its life and maintaining its accuracy. Negative or reverse voltage overload protection for the ohms converter circuit is provided by a blocking diode D6, which blocks an application of a negative voltage to the circuit. Additionally, positive voltage overload protection is provided by two clamping diodes D3 and D4, coupled between the circuit loop and ground, which protect against positive high voltage overloads for the circuit loop by clamping the anodes thereof to a given positive voltage. Diodes D3 and D4 are low leakage (less than 1 pico amp.) diodes. A further clamping diode D5 is provided such that when Rx is an extremely large resistance, e.g. hundreds of Mohms, or an open circuit is provided instead of Rx, clamping diode D5 prevents the voltage at node 50 from being pulled down below −4.7 V to the lower potential of −9.9 V, and thereby possibly damaging a circuit under test. Diode D5 has its anode at −4.3 V, and will start conducting with a −0.4 V thereacross, such that the cathode thereof is clamped to −4.7 V.

In summary, the scaler resistor Rscaler is connected in a loop circuit in which the voltage drop across Rscaler is maintained equal to the voltage drop across a floating potential resistor Rfp. The resistor Rfp is connected to a stable constant current generator, such that the voltage drop across Rfp is maintained constant, and the voltage drop across Rscaler is thereby maintained constant, which results in a highly stable current through Rscaler. For reasons explained hereinbelow, the current through Rscaler does not branch at node 50 or otherwise, but proceeds as Iref through diode D6, through Rx and Rref.

The inputs of U1, U2 and U4 are MOS FET transistors, so the currents through R12 and R11 are very small, making the voltage drop over R12 and R11 less than 0.4 uV.

Therefore:

V70=V40 (voltage at node 70 equals voltage at node 40)

V100=V50

U2 is a voltage follower with no voltage drop thereacross, therefore:

V80=V70

V90=V80+RfpIfp

RfpIfp=0.7 V

U1 loop is closed via R10, Q1, Rscaler and R12 and it stabilized when:

V100=V90 which can also realized as:

V50=V90

V50=V80+0.7 V

V50=V40+0.7 V

V50−V40=0.7 V so when Rscaler=1 Kohms, the circuit will output 0.7/1,000=0.7 mA, and when Rscaler=1 Mohms, the circuit will output 0.7/1,000,000=0.7 uA.

Q1, D5 and D6 are the only high voltage withstanding components, selected to withstand a minimum of 350 volts at the input terminals which are also the digital multimeter input terminals. D6 will block an application of −5 to −350 volts.

When a positive voltage is applied to the output terminals, D6 conducts, and since the current source initially continues to operate, it will require over 1.2 volts to bring V50 to a voltage more positive than ground. U4 is used as a comparator, and will flip to output −9.9 V (in normal operation V50 is always more negative than ground so the U4 output is at +4.7 V), node 180 will change from +2.35 V to −4.95 V, D2 will conduct and node 70 will follow node 180 to −4.3 V. Node 90 will then be −4.3 V+0.65 V=3.65 V, with +0.4 V at the inv. input and −3.65 V at the noninv. input, the output of U1 will go all the way to the negative rail, and Q1 will be turned off.

The maximum power that Rref will be dissipating, in the Mohms range with +350 V at the MDMM input, is $((350/(1000+360{,}000+1{,}000{,}000))^2 \cdot 1{,}000{,}000=66$ mW.

In ranges where 1 Kohms is being utilized, V50 follows the input with a minimal voltage drop over Rref, hence V50 can get as high as 350 V, therefore D5 is a high voltage diode with low reverse leakage, less than 500 pA at 25° C. and full reverse voltage.

In accordance with the disclosure herein, an ohms converter circuit is designed to produce an output constant current of 0.7 mA or 0.7 uA, with a voltage compliance of 4.7 Volts. The constant current flows through a reference resistor Rref (1 Kohms or 1 Mohms) with no possible current branching (Iscaler=Iref).

The current source is electrically and electrostatically isolated (floating), and can withstand an application of up to +/−350 volts to its output terminals.

The circuit eliminates any possible current branching between Rscaler and Rx, and prevents damages to Rref when a high voltage is connected to the input of the digital multimeter (DMM) while in an ohms measurement mode.

Figure 5:
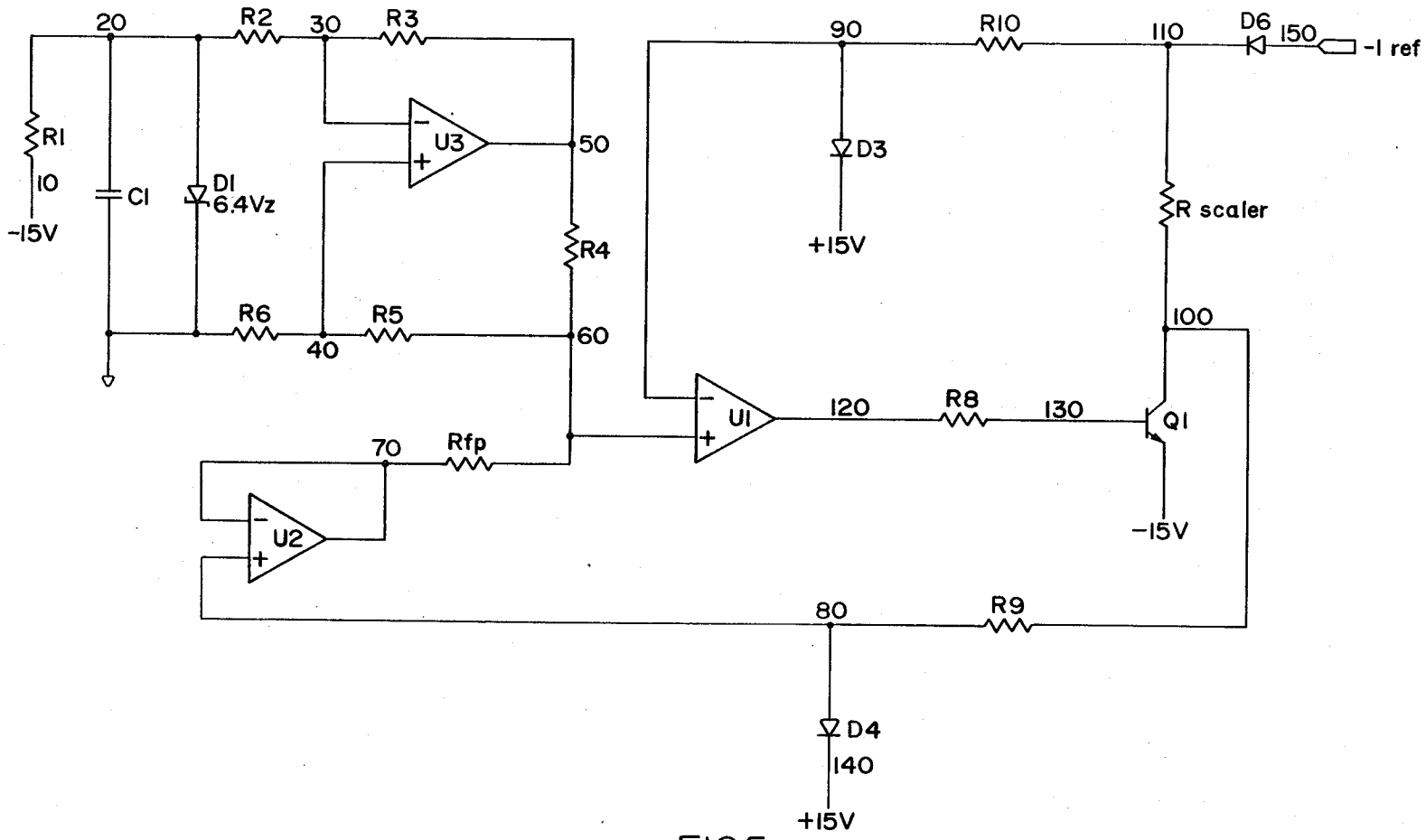
FIG. 5 is a schematic circuit of a negative current stable current source of the present invention, similar to that employed in the ohms converter circuit of FIG. 4, but illustrating only details of the negative current stable current source.

FIG. 5 is an electrical schematic of a preferred embodiment of a stable current source pursuant to the teachings of the present invention for providing a negative output current. The operation of this current source is similar to that of the current source illustrated in FIG. 4. In this circuit, the voltage across a scaler resistor Rscaler, established by the output current Iref of the stable current source passing therethrough, is compared with a voltage supplied by a floating potential, established by a steady current generator supplying a steady current to a floating potential resistor Rfp to provide a steady floating potential thereacross. A differential amplifier U1 compares the two voltages as inputs thereto, and controls the generation of the current of known magnitude Iref in accordance with the differential measurement of the voltages.

In this embodiment, the steady current for Rfp is provided by U3, which is an MOS amplifier with a temperature compensated Zener diode D1. The steady current source I provides a steady current through the floating potential resistor Rfp to establish a steady bias voltage drop thereacross. U3 produces a steady current=(R3 Vz)/(R2 R6). The use of a temperature compensated Zener reference diode D1 reduces the temperature coefficient of this current source to just a few parts per million.

In summary, the scaler resistor Rscaler is connected in a loop circuit in which the voltage drop across Rscaler is maintained equal to the voltage drop across a floating potential resistor Rfp. The resistor Rfp is connected to a steady current generator, such that the voltage drop across Rfp is maintained constant, and the voltage drop across Rscaler is thereby maintained constant, which results in a highly stable current through Rscaler.

An inverting NPN transistor amplifier Q1 is connected in the loop circuit for providing the current of known magnitude Iref through the scaler resistor Rscaler, and establishes a voltage drop IrefRscaler thereacross equal to the voltage drop across Rfp. The inverting amplifier Q1 is coupled to the output of the differential amplifier U1 for providing enhanced voltage compliance and for isolation in the event of the accidental application of a high voltage to the circuit. The inverting amplifier is a transistor amplifier, and a voltage follower circuit U2 is coupled to the floating potential resistor Rfp to prevent the current therethrough from flowing to the collector of the transistor inverting amplifier Q1.

The current source is electrically and electrostatically isolated (floating), and can withstand an application of up to +/−350 volts to its output terminals.

Q1 and D6 are the only high voltage withstanding components, selected to withstand a minimum of 350 volts at the input terminals, such that D6 will block an application of −5 to −350 volts. Accordingly, negative or reverse voltage overload protection for the stable current source circuit is provided by a blocking diode D6, which blocks an application of a negative voltage to the circuit. Additionally, positive voltage overload protection is provided by two clamping diodes D3 and D4, coupled between the circuit loop and the positive voltage supply, which protect against positive high voltage overloads for the circuit loop by clamping the anodes thereof to a given positive voltage. Diodes D3 and D4 are low leakage (less than 1 pico amp.) diodes.

Figure 6:
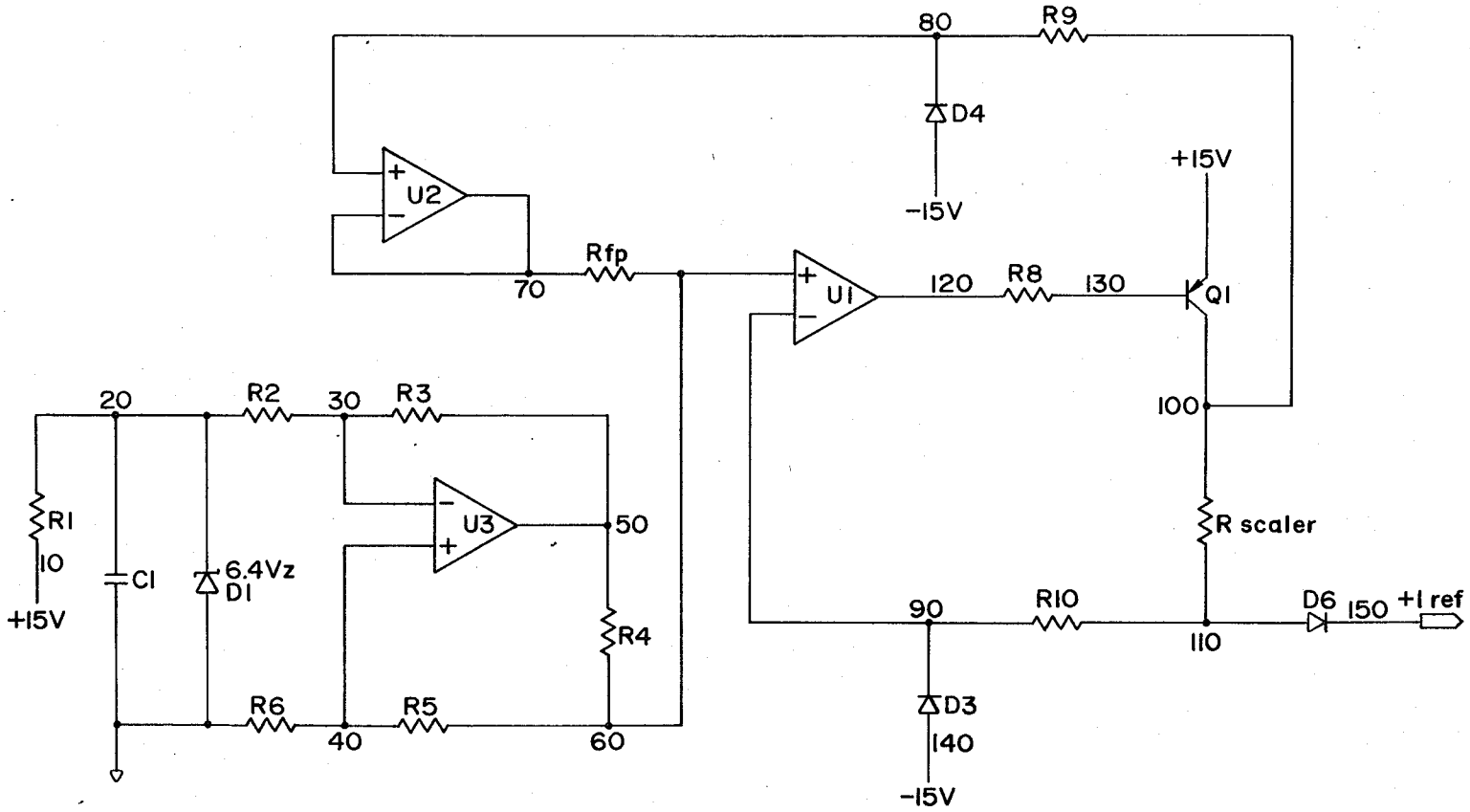
FIG. 6 is a schematic circuit of a positive current stable current source similar in design to the circuit of FIG. 5, but employing a PNP transistor rather than an NPN transistor.

FIG. 6 is a schematic circuit of a second preferred embodiment of a stable current source circuit constructed pursuant to the teachings of the present invention, for providing a positive current output +Iref. The operation of this circuit is similar in several respects to the circuit of FIG. 5, with the following additional explanations. The polarities of the positive current source circuit of FIG. 6 are generally reversed with respect to the polarities of the negative current source circuit of FIG. 5, and the NPN transistor Q1 of FIG. 5 has been replaced by a PNP transistor Q1 in FIG. 6. The polarities of the steady current generator circuit for U3 have been reversed. The diodes, D3, D4 and D6 are now oppositely poled to reflect the opposite polarities of the voltage supplies for the circuit.

While several preferred embodiments of the present invention for an ohms converter circuit are described in detail herein, it should be apparent that the disclosure and teachings of the present invention will suggest many alternative designs to those skilled in the art.

What is claimed is:

1. A stable current source circuit for supplying a current of known magnitude Iref, comprising a scaler resistor having the current of known magnitude Iref passing therethrough to develop a voltage drop thereacross, a floating potential circuit connected to said scaler resistor in a loop circuit, and a differential amplifier coupled to differentially measure the voltages across said scaler resistor and said floating potential circuit and provide an output indicative thereof which determines Iref, such that the voltage drop across the scaler resistor equals the voltage drop across the floating potential and the current Iref through said scaler resistor remains constant at a known magnitude.

2. A stable current source circuit as claimed in claim 1, including an inverting amplifier coupled to the output of said differential amplifier for providing enhanced voltage compliance and for isolation in the event of the accidental application of a high voltage to the circuit.

3. A stable current source circuit as claimed in claim 2, said floating potential comprising a steady current source I and a floating potential resistor Rfp.

4. A stable current source circuit as claimed in claim 3, wherein said inverting amplifier is a transistor amplifier having a transistor with an emitter, a base and a collector, and further including a voltage follower circuit coupled to said floating potential resistor to prevent the current through said floating potential resistor from flowing to the collector of said transistor inverting amplifier.

5. A stable current source circuit as claimed in claim 4, wherein the output of the stable current source includes a blocking diode which provides reverse high voltage overload protection for the current source circuit.

6. A stable current source circuit as claimed in claim 5, said steady current source including an MOS amplifier, and said differential and inverting amplifiers and said voltage follower circuit also comprising MOS circuits.

7. A stable current source circuit as claimed in claim 6, said steady current source including a Zener diode for providing temperature compensation therefor.

8. A stable current source circuit as claimed in claim 7, said loop circuit further comprising two clamping diodes coupled between the circuit loop and ground which provide high voltage overload for the loop circuit by clamping the anodes thereof to a given positive voltage.

9. A stable current source circuit as claimed in claim 7, said loop circuit further comprising two clamping diodes, each having an anode and a cathode, coupled between the circuit loop and a negative voltage which provide high voltage overload for the loop circuit by clamping the cathodes thereof to a given negative voltage.

10. A stable current source circuit as claimed in claim 1, said floating potential comprising a steady current source I and a floating potential resistor Rfp.

11. A stable current source circuit as claimed in claim 1, further including an inverting transistor amplifier coupled to the output of said differential amplifier, and a voltage follower circuit coupled to said floating potential resistor to prevent the current through said floating potential resistor from flowing to the collector of said inverting transistor amplifier.

12. A stable current source circuit as claimed in claim 1, wherein the output of the stable current source includes a blocking diode which provides reverse high voltage overload protection for the stable current source circuit.

13. A stable current source circuit as claimed in claim 1, said loop circuit further comprising two clamping diodes coupled between the circuit loop and ground which provide high voltage overload for the loop circuit by clamping the anodes thereof to a given positive voltage.

14. A stable current source circuit as claimed in claim 1, said loop circuit further comprising two clamping diodes, each having an anode and a cathode, coupled between the circuit loop and a negative voltage which provide high voltage overload for the loop circuit by clamping the cathodes thereof to a given negative voltage.

15. A stable current source circuit as claimed in claim 1, said loop circuit further comprising two clamping diodes, each having an anode and a cathode, coupled between the circuit loop and a positive voltage, which provide high voltage overload for the loop circuit by clamping the anodes thereof to a given positive voltage.

* * * * *